US005188542A

United States Patent [19]

Ballman

[11] Patent Number: 5,188,542

[45] Date of Patent: Feb. 23, 1993

[54] ELECTRICAL CONNECTOR WITH INTEGRAL STRAIN RELIEF AND MOUNT, AND OVERTEMPERATURE INDICATOR

[76] Inventor: Gray Ballman, 20419 Wildcat Run Dr., Estero, Fla. 33928

[21] Appl. No.: 803,181

[22] Filed: Dec. 5, 1991

[51] Int. Cl.[5] ..... H01R 13/66

[52] U.S. Cl. ..... 439/620; 439/465

[58] Field of Search ..... 361/105, 106, 119; 340/636, 654, 656; 439/462, 465, 490, 620, 695, 696, 456, 457

[56] References Cited

U.S. PATENT DOCUMENTS

| | | | |
|---|---|---|---|
| 3,913,956 | 10/1975 | Eidelberg et al. | 439/462 X |
| 4,310,837 | 1/1982 | Kornrumpf et al. | 361/106 X |
| 4,738,636 | 4/1988 | Bolante | 439/462 |
| 4,969,834 | 11/1990 | Johnson | 439/490 |

FOREIGN PATENT DOCUMENTS

| | | | |
|---|---|---|---|
| 0078364 | 5/1985 | Japan | 340/636 |

*Primary Examiner*—Eugene F. Desmond

*Attorney, Agent, or Firm*—Rogers, Howell & Haferkamp

[57] ABSTRACT

An electrical connector of generally clam-shell construction includes an integral mount at the cable end of only one connector half to thereby provide an integral mount for a flexible strain relief. Additionally, a P.C. board mounted overtemperature sensing circuit is contained within the connector to sense an overtemperature condition inside the connector itself and illuminate an LED to provide a visual indication to an operator that an overtemperature condition has occurred. The LED remains illuminated so long as the connector is connected in circuit with the battery being charged and will remain so even after the battery charger's automatic circuitry reduces or cuts off charger power to the circuit. The circuit automatically resets itself for reuse upon disconnection (and cooling) of the connector from the charging circuit.

22 Claims, 2 Drawing Sheets

ELECTRICAL CONNECTOR WITH INTEGRAL STRAIN RELIEF AND MOUNT, AND OVERTEMPERATURE INDICATOR

BACKGROUND AND SUMMARY OF THE INVENTION

Electrical connectors are commonly used to terminate electrical cords for various electrical and electronic appliances with the connector typically having male prongs for insertion into a female receptacle to thereby connect and disconnect the electrical appliance from a suitable power source. Additionally, electrical connectors are also used with devices such as battery chargers to terminate electrical cables which carry the charging current so that the connector may be readily inserted into a female receptacle which is electrically in circuit with one or more batteries desired to be recharged. One such particular application is for electrically powered golf carts commonly used on most golf courses. In these particular applications, the golf cart has a female connector which facilitates the recharging of the battery overnight after a full day's usage on the golf links. These female receptacles are generally provided with spring tension contact clips into which the male blades of the electrical plug are inserted in order to complete the electrical connection therebetween. Because of the charging currents utilized, it is not uncommon for the blade and spring clips to heat as the charging current is conducted therethrough. Over time, this temperature rise takes the temper out of the brass spring clips which, along with the natural tendency of the clips to "loosen" as a result of the repetitive insertion and removal of the male connector, further weakens the contact pressure between the blade and clips to thereby create an ever worsening cycle of increased temperature during the charging procedure. Because the case of the electrical connector surrounds the male blades, the case being typically made from any hardened plastic such as bakelite or the like, the connector itself may overheat and fail and, in extreme situations, even cause a fire. This is especially a risk when the golf carts are left unattended overnight as they are charged.

Electrical connectors of the kind described herein are typically used to terminate electrical cables substantially larger than is used in most consumer applications. As a result, it is well-known in the art to utilize strain reliefs at the juncture between the electrical connectors and the cable end, those strain reliefs serving not only to mechanically reinforce the juncture, but also restrict the radius about which the cable may be bent and also help minimize the possibility for mechanical damage resulting from an operator tugging on the cord to remove the connector from the receptacle. Typically, in the prior art, clam-shell type electrical connectors were utilized, these clam-shell type connectors being comprised essentially of two halves which are split along the length of the electrical connector, with the strain relief being captured between these two halves and with one or more screws or the like used to join the halves. Unfortunately, with this particular construction, there is a tendency for the connector to "clam-shell" or separate at the point where the strain relief is mounted due to the excessive mechanical forces caused at that juncture by abuse and improper use of the connector and cable by an operator. When this happens, it is not uncommon for the connector and cable to mechanically separate thereby causing a failure. In some cases, this mechanical difficulty can also lead to a hidden weakening or separation of the electrical connections contained within the connector which might lead to increased heating and also further create the possibility for a catastrophic failure such as a short circuit or open circuit condition within the connector, or even a fire.

In order to solve these and other problems in the prior art, the inventor herein has succeeded in designing and developing an electrical connector with an integral mount for a strain relief as well as an overtemperature indicator which senses an overtemperature condition and provides a visual indication to an operator that an overtemperature condition has occurred even after the charging current supplied by the battery charger has been automatically terminated. The electrical connector of the present invention is essentially of clam-shell construction except that at the cable end thereof, one of the connector halves includes as an integral part thereof an end plate with a hole therethrough for anchoring of a strain relief. The end plate is integral and uninterrupted about the hole such that the tendency for the connector to "clam-shell" is eliminated. In this orientation significantly greater mechanical stresses are readily accommodated and do not result in damage to the connector or to the possible separation of the electrical connections within the connector.

Within the interior of the connector, there is mounted a miniature P.C. board and an electronic circuit thereon including a thermistor for sensing a temperature rise above a pre-selected "overtemperature" value which fires a PUT or SCR which illuminates an LED and is latched on so long as the electrical connector remains plugged into the receptacle, thereby being in circuit with the batteries mounted on board the golf cart. This LED is of relatively small size and extends through a small opening in the connector case. Thus, should an overtemperature condition occur, an operator may readily observe the LED being illuminated before the connector is finally disconnected from the golf cart prior to its use, even though the charging cycle may have been completed some hours previously and the connector has had time to cool to ambient temperature. The operator is then in a position to inspect the female receptacle for deterioration of the contact springs and their replacement, or other correction of the situation which caused the overtemperature condition. As can be appreciated, this provides a significant advantage and improvement over the prior art in that it greatly enhances the safety of the charging process which is generally performed without constant supervision, in unattended areas, and for significant time periods.

While the principle advantages and features of the present invention have been described briefly above, a greater understanding and fuller appreciation for the invention may be obtained by referring to the drawings and preferred embodiment which follow.

BRIEF DESCRIPTION OF THE DRAWINGS

FIG. 1 is a perspective view of an electrical connector of the present invention inserted into a female receptacle for a golf cart or the like;

DETAILED DESCRIPTION OF THE PREFERRED EMBODIMENT

Figure 1:
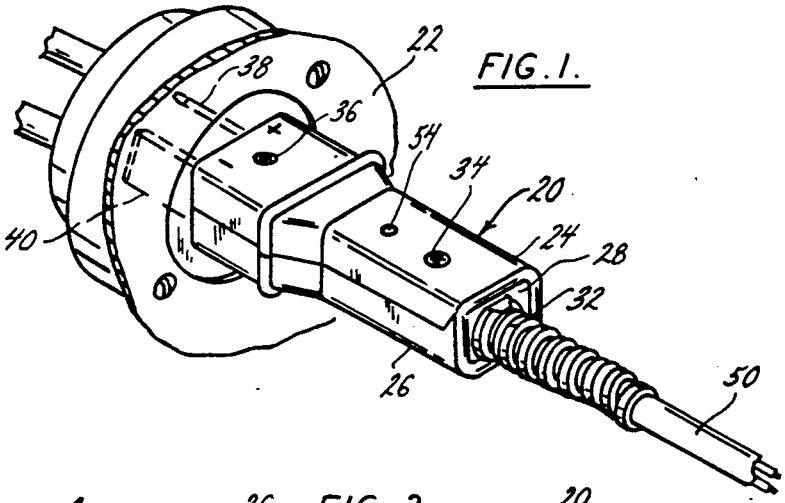
Figure 2:
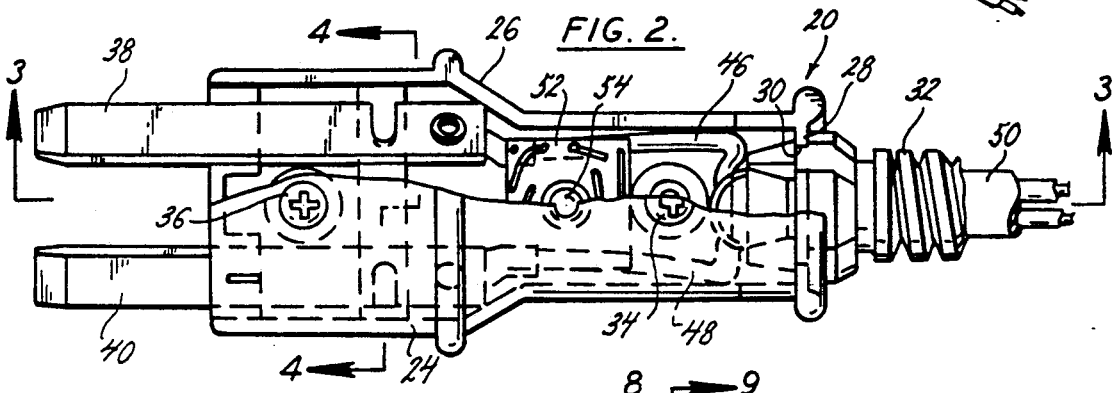
FIG. 2 is a side view with partial cross-section detailing the connector interior.
Figure 3:
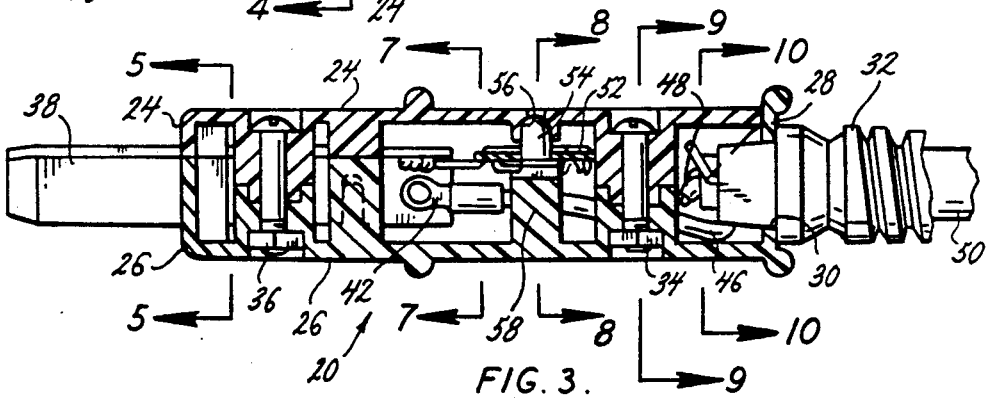
FIG. 3 is a partial cross-sectional view of the connector taken along the line 3—3 in FIG. 2 and further detailing the interior construction thereof.
Figure 5:
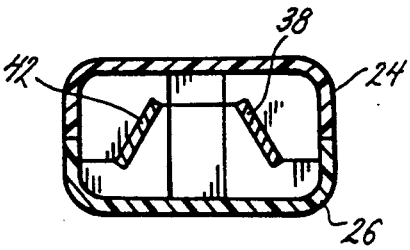
FIG. 5 is a partial cross-sectional view taken along the plane of line 5—5 in FIG. 3 and further detailing the male blade arrangement.
Figure 4:
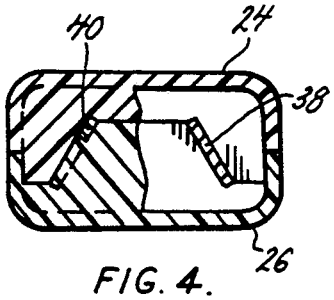
FIG. 4 is a partial cross-sectional view taken along the plane of line 4—4 in FIG. 2 and detailing the male blade mounting arrangement.
Figure 6:
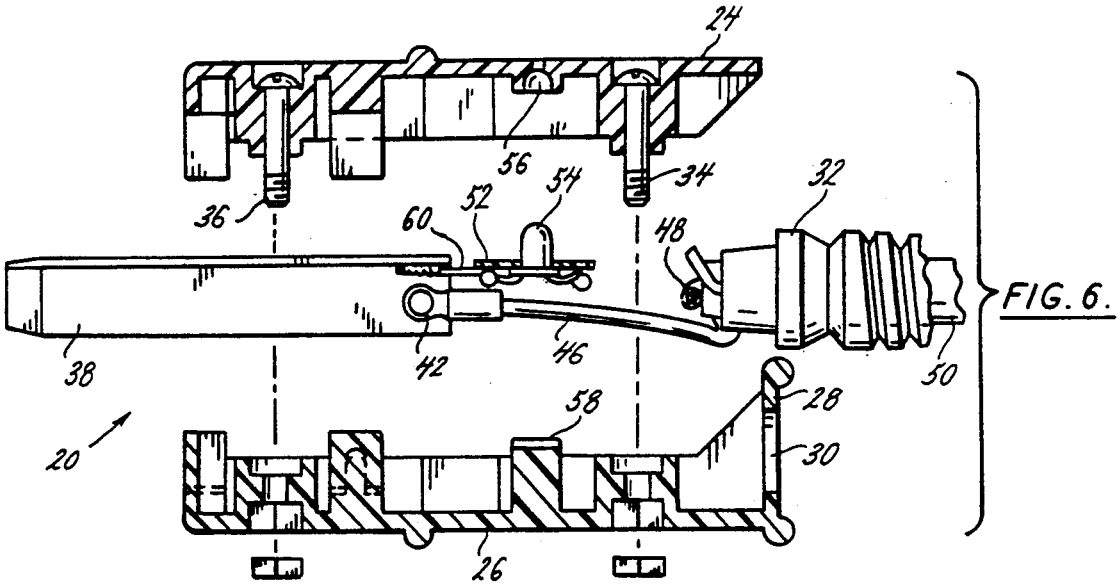
FIG. 6 is an exploded view of the connector detailing the partial clam-shell construction with integral strain relief mount at the cable end of one-half thereof.
Figure 7:
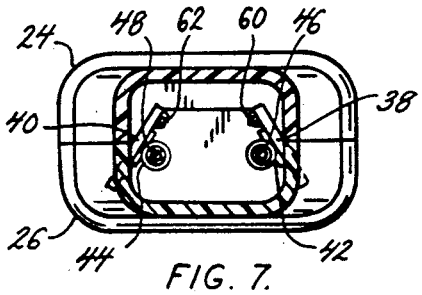
FIG. 7 is a partial cross-sectional view taken along the plane of line 7—7 in FIG. 3 and detailing the electrical connections to the male blades.
Figure 8:
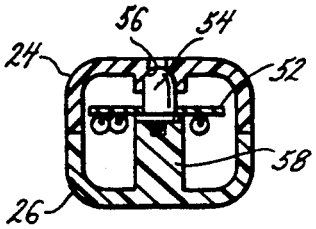
FIG. 8 is a partial cross-sectional view taken along the plane of line 8—8 in FIG. 3 and detailing the mechanical mounting of the P.C. board and LED in the connector case.
Figure 9:
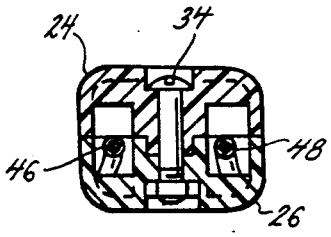
FIG. 9 is a partial cross-sectional view taken along the plane of line 9—9 in FIG. 3 and detailing the nut and bolt attachment securing the two connector halves together.
Figure 10:
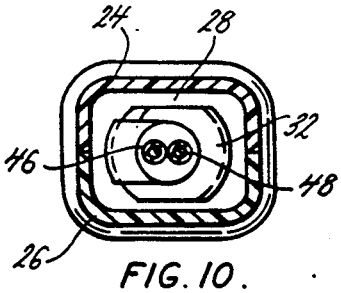
FIG. 10 is a partial cross-sectional view taken along the plane of line 10—10 in FIG. 3 and detailing the mounting of the strain relief in the end plate of one of the connector halves.

As shown in FIG. 1, the electrical connector 20 of the present invention is a blade type male connector suitable for insertion into a female receptacle 22 as might be found on a golf cart or the like for recharging the batteries used to power it. The mechanical details of the connector 20 of the present invention is best shown in FIGS. 2, 3 and 6 and includes an upper half 24 and a lower half 26, the lower half 26 having an end plate 28 with a hole 30 therethrough adapted for mounting of a flexible strain relief 32. A pair of nut and bolt assemblies 34, 36 attach the halves 24, 26 together in generally clam-shell fashion except for the strain relief mount of end plate 28. A pair of brass blades 38, 40 are connected by a solder joint 42, 44 to the individual wires 46, 48 comprising electrical cable 50. A relatively small P.C. board 52 which contains the overtemperature circuit of the present invention includes an upstanding LED 54 which extends into a generally cylindrical opening 56 formed in the upper half 24 of connector case 20 and which serves to locate P.C. board 52 therewithin. Beneath P.C. board 52 is an upstanding platform 58 integrally formed as part of the bottom half 26 of connector 20 which serves to capture and retain LED 54 within cylindrical opening 56 to thereby physically locate the P.C. board 52 within the connector 20. A pair of leads 60, 62 from P.C. board 52 also are soldered to blades 38, 40 to thereby electrically connect P.C. board 52 in circuit with blades 38, 40. The connector halves 24, 26 may be made from any heat resistant plastic material, such as bakelite or the like in order to withstand elevated temperatures normally experienced in this environment.

Figure 11:
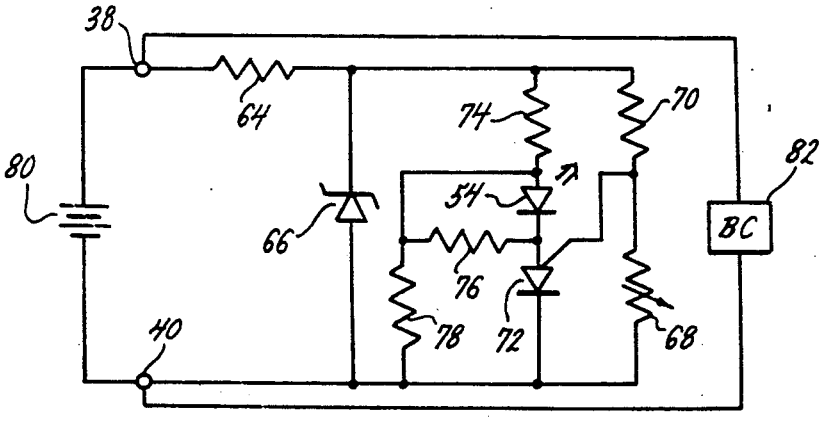
FIG. 11 is a schematic diagram of the electrical circuit contained on the P.C. board mounted within the connector.

The electrical circuit mounted on P.C. board 52 is shown in FIG. 11 and includes a resistor 64 for stepping down the input voltage, a zener diode 66 which sets the operating voltage for the rest of the circuit, a thermistor 68 whose resistance value changes as a result of a change in temperature, a second resistor 70 to complete a resistor bridge, a PUT 72 for switching LED 54, a resistor 74 to ensure reliable operation of LED 54, and a pair of resistors 76, 78 to establish a set point voltage for the anode of PUT 72 and to maintain it in conduction upon firing. The blades 38, 40 are shown representationally as junctions in the circuit in FIG. 11 and a battery 80 with battery charger 82 which completes the circuit as typically found, at least schematically, in a battery charger application.

In operation, the circuit shown in FIG. 11 serves to sense an overtemperature condition experienced in the connector, light an LED to give a visual indication to an operator that an overtemperature condition has occurred, and maintain the LED illuminated so long as the connector remains plugged in to the female receptacle of the golf cart and is thereby connected to the battery power contained in the golf cart itself. Its sequence of operation is as follows. Upon initial insertion of the connector, the resistance value of thermistor 68 is sufficient to prevent the firing of PUT 72, thereby maintaining LED 54 in an off condition. As current from the battery charger 82 flows through the blades 38, 40 to battery 80, and the blades heat up, thereby heating up the connector itself, the ambient temperature within the connector rises which causes resistance value of thermistor 68 to reduce, thereby firing PUT 72 to illuminate LED 54. At the end of the charging cycle, the charger 82 may turn off thereby permitting the connector to cool to ambient temperature. The resistance value of thermistor 68 will then rise again, but PUT 72 stays in a conducting state. As long as blades 38, 40 are connected through the receptacle 22 to battery 80, the circuit is connected to a power source and LED 54 remains illuminated. However, upon removal of the connector from the receptacle, and the separation of blades 38, 40 therefrom, the battery 80 is disconnected from the circuit as shown in FIG. 11 which de-energizes LED 54, presuming battery charger 82 is de-energized as well.

Thus, with the circuit of the present invention, an overtemperature condition occurring in the connector is sensed and an LED is illuminated to indicate to an operator that an overtemperature condition has occurred even after the connector has cooled to ambient temperature. Furthermore, the circuit resets itself upon removal of the connector from the receptacle (and cooling) so that it may be reused after the problem causing the overheating has been found and cured.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. An electrical plug-in connector, said connector having a multi-part case, and an electrical cord terminated in said case, said case being split generally longitudinally into two parts, one of said parts having means for substantially entirely surrounding and securing said electrical cord at an end thereof, said other part being shorter in length than said one part, said other part matching and lining up with a connection end of said one part, and said one of said parts having said cord securing means including a cord end substantially larger than the cord end of the other of said parts so that the cord end of said one part comprises substantially the entirety of the cord end of said connector case.

2. The connector of claim 1 further comprising a cord strain relief, said securing means having means for securing said cord strain relief.

3. The connector of claim 2 wherein said securing means includes means defining a hole in said one part, said hole being adapted for receiving and securing said strain relief and cord.

4. The connector of claim 1 further comprising means for sensing an overtemperature condition as said connector is connected to a source of electrical power, and means for providing an indication thereof to an operator.

5. The connector of claim 4 wherein said indicator means includes means for maintaining said indication despite a reduction of temperature of said connector below said overtemperature condition.

6. The connector of claim 5 wherein said indication means includes means for maintaining said indication for so long as said connector is connected to said source of electrical power.

7. The connector of claim 6 wherein said connector is a male type connector including at least one blade adapted for insertion into a female receptacle, and wherein said indication means includes means for resetting itself upon removal of said connector from said receptacle.

8. The connector of claim 7 wherein said indicator means includes an electronic circuit and said sensing means includes a thermistor in circuit with said electronic circuit.

9. The connector of claim 8 wherein said electronic circuit includes an LED, said LED comprising a visual indication to said operator of an overtemperature condition upon illumination thereof.

10. The connector of claim 9 wherein said connector is in circuit with a battery charger, and said connector is adapted for conducting a charging current into said receptacle to thereby charge a battery, and said battery charger has means for switching off said charging current upon completion of a charging cycle, so that said sensing means will sense an overtemperature condition created during said charging cycle, illuminate said LED, and maintain said LED illuminated after said charging current is switched off.

11. The connector of claim 9 further comprising a P.C. board, said P.C. board having means for mounting said electronic circuit, and said case having means for internally mounting said P.C. board.

12. The connector of claim 11 wherein said case has an opening therein, said opening being positioned to receive said LED to thereby locate said LED and P.C. board inside said case.

13. An electrical plug-in connector, said connector including means for sensing an overtemperature condition as said connector is connected to a source of electrical power, and means for indicating the sensed occurrence of said overtemperature condition, said indication means including means for maintaining said indication despite a reduction of temperature of said connector below said overtemperature condition.

14. The connector of claim 13 wherein said indication means includes means for maintaining said indication for so long as said connector is connected to said source of electrical power.

15. The connector of claim 14 wherein said connector is a male type connector including at least one blade adapted for insertion into a female receptacle, and wherein said indication means includes means for resetting itself upon removal of said connector from said receptacle.

16. The connector of claim 15 wherein said indicator means includes an electronic circuit and said sensing means includes a thermistor in circuit with said electronic circuit.

17. The connector of claim 16 wherein said electronic circuit includes an LED, said LED comprising a visual indication to said operator of an overtemperature condition upon illumination thereof.

18. The connector of claim 17 wherein said connector is in circuit with a battery charger, and said connector is adapted for conducting a charging current into said receptacle to thereby charge a battery, and said battery charger has means for switching off said charging current upon completion of a charging cycle, so that said sensing means will sense an overtemperature condition created during said charging cycle, illuminate said LED, and maintain said LED illuminated after said charging current is switched off.

19. The connector of claim 17 further comprising a P.C. board, said P.C. board having means for mounting said electronic circuit, and said case having means for internally mounting said P.C. board.

20. The connector of claim 19 wherein said case has an opening therein, said opening being positioned to receive said LED to thereby locate said LED and P.C. board inside said case.

21. An electrical plug-in type, male connector for a battery charger, said connector having a case comprised of two parts, each of said parts being approximately half of said case except that one of said parts has an integral mounting hole for a strain relief at an end thereof, and a P.C. board mounted overtemperature circuit with an LED, said LED extending through a hole in said case, said circuit having means to sense an overtemperature condition in said case as said connector is connected to a source of electrical power and illuminate said LED in response thereto.

22. The connector of claim 21 wherein said circuit has means for maintaining said LED illuminated, once illuminated by said circuit, until said connector is disconnected from said source of electrical power.

* * * * *